US006838965B1

(12) United States Patent
Von Gaisberg et al.

(10) Patent No.: US 6,838,965 B1
(45) Date of Patent: Jan. 4, 2005

(54) ELECTROMAGNETIC ACTUATOR AND METHOD FOR ADJUSTING SAID ELECTROMAGNETIC ACTUATOR

(75) Inventors: Alexander Von Gaisberg, Beilstein (DE); Dirk Strubel, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 44 days.

(21) Appl. No.: 10/019,336

(22) PCT Filed: Jun. 7, 2000

(86) PCT No.: PCT/EP00/05210

§ 371 (c)(1),
(2), (4) Date: Dec. 18, 2001

(87) PCT Pub. No.: WO00/79106

PCT Pub. Date: Dec. 28, 2000

(30) Foreign Application Priority Data

Jun. 18, 1999 (DE) ..... 199 27 823

(51) Int. Cl.[7] ..... H01H 7/08
(52) U.S. Cl. ..... 335/274; 123/90.11; 254/129.15
(58) Field of Search ..... 335/274; 123/90.11; 251/129.15

(56) References Cited

U.S. PATENT DOCUMENTS

| | | | | |
|---|---|---|---|---|
| 3,882,833 A | | 5/1975 | Longstaff et al. | |
| 4,809,742 A | * | 3/1989 | Grau | 137/554 |
| 5,117,213 A | * | 5/1992 | Kreuter et al. | 335/219 |
| 5,199,392 A | | 4/1993 | Kreuter et al. | |
| 5,548,263 A | * | 8/1996 | Bulgatz et al. | 335/274 |
| 5,636,601 A | | 6/1997 | Moriya et al. | |
| 5,804,962 A | | 9/1998 | Kather et al. | |
| 5,822,167 A | * | 10/1998 | Schmitz | 361/143 |
| 5,934,231 A | | 8/1999 | Schmitz et al. | |
| 6,021,749 A | | 2/2000 | Gaisberg | |
| 6,176,208 B1 | * | 1/2001 | Tsuzuki et al. | 123/90.11 |
| 6,230,763 B1 | | 5/2001 | Till | |
| 6,481,395 B2 | * | 11/2002 | Kreitmann et al. | 123/90.11 |

FOREIGN PATENT DOCUMENTS

| | | |
|---|---|---|
| DE | 19529152 | 2/1997 |
| DE | 19631909 | 2/1997 |
| DE | 19725010 | 10/1998 |
| DE | 19733142 | 2/1999 |
| DE | 19849036 | 5/2000 |
| EP | 0328192 | 8/1989 |
| JP | 2-81940 | 3/1990 |
| WO | WO97/17561 | 5/1997 |

OTHER PUBLICATIONS

"The Adaptive Fuzzy Control of Electromagnetic Actuator in Diesel Fuel Injection System"; Yuanchun Li et al.; Vehicle Electronics Conference, 1999, Sep. 6–9, 1999; Page(s): 149–152, vol. 1.

* cited by examiner

*Primary Examiner*—Lincoln Donovan
*Assistant Examiner*—Bernard Rojas
(74) *Attorney, Agent, or Firm*—W. F. Fasse; W. G. Fasse

(57) ABSTRACT

An electromagnetic actuator includes two electromagnets spaced apart from one another, an armature that is movable back and forth by magnetic force between the electromagnets against the force of two respectively counteracting springs, and setting means for adjusting the actuator to have a low energy requirement. To this end, the springs are pre-stressed such that the same energy is stored in both springs in connection with a maximum compression of the springs corresponding to the maximum stroke travel distance of the armature. The actuator is useful for actuating a valve to control the gas exchange in an internal combustion machine.

17 Claims, 2 Drawing Sheets

ELECTROMAGNETIC ACTUATOR AND METHOD FOR ADJUSTING SAID ELECTROMAGNETIC ACTUATOR

FIELD OF THE INVENTION

The invention relates to an electromagnetic actuator and a method for adjusting an electromagnetic actuator.

BACKGROUND INFORMATION

An electromagnetic actuator for operating a gas exchange valve in an internal combustion machine is known from the DE 196 31 909 A1. The actuator comprises two electromagnets arranged at a spacing distance relative to one another, and an armature that is in operative connection with the gas exchange valve and that is movable back and forth by magnetic force between the electro-magnets against the force of two respectively counteracting springs. The actuator further comprises setting means, with which the position of the armature is set to the geometric center position between the two end positions of the armature in connection with de-energized electromagnets. In this regard, the high dependency of the energy requirement of the actuator on production tolerances is found to be disadvantageous.

SUMMARY OF THE INVENTION

In view of the above, it is an object of the invention to provide an electromagnetic actuator of the above mentioned general type, which has been further developed so that the energy requirement only slightly depends on the production tolerances. It is a further object of the invention to provide a method of adjusting an electromagnetic actuator, by which the dependency of the energy requirement of the actuator on production tolerances is minimized.

The above objects have been achieved according to the invention in an electromagnetic actuator including an armature that is arranged to move back and forth against the force of two opposed springs between two spaced-apart electromagnets due to the magnetic forces applied by the electromagnets. The above objects have further been achieved according to the invention in a method of adjusting an electromagnetic actuator of the above mentioned construction.

According to the invention, the springs are pre-stressed in such a manner that the same energy will be stored in both springs in connection with a compression of the springs respectively by a spring travel distance prescribed by the limited stroke travel distance of the armature. Hereby one achieves, that the armature, when it is released from its two end positions and freely oscillates, will approach close to the two electromagnets to the same extent. As a result thereof, the influence of production-necessitated tolerances of the components, and especially of the springs, on the oscillating behavior of the armature is reduced. Moreover, the total energy requirement of the actuator is optimized, because both electromagnets comprise the same current requirement due to the armature approaching equally closely to the two electromagnets. Namely, if the armature would approach more closely to the one electromagnet than to the other during the free oscillation, then the current requirement of the one electromagnetic would drop by a certain amount, but the current requirement of the other electromagnet would increase by a multiple of this amount, so that also the total energy requirement of the actuator would increase relative to the optimal value.

Preferably, at least one of the springs comprises a non-linear spring characteristic, advantageously a characteristic with a maximum value at a position of the armature lying between the electromagnets. Due to the non-linear spring characteristic of one or both of the springs, it is on the one hand ensured that the armature is accelerated with large forces, which has a high switching frequency as a result, and on the other hand one thereby achieves that small forces act in the end positions of the armature, so that also the energy requirement of the actuator for holding the armature in its end positions is small.

For the adjustment of this electromagnetic actuator, for each spring the variation or progression of the spring force is measured as the respective spring is compressed by a spring travel distance corresponding to the stroke travel distance of the armature. The energy, which is stored in the respective spring due to the compression thereof, is determined from the measured curves or progressions of the varying spring forces over the spring travel distances of the springs. Next, the pre-stressing of one or both springs is set in such a manner that the same energy is stored in both springs.

The adjustment of the actuator can be carried out during the manufacturing of the actuator, but an adjustment during the operation is also conceivable, in order to compensate changes of operating values or parameters, as they may arise, for example, due to temperature effects, wear, or aging.

BRIEF DESCRIPTION OF THE DRAWINGS

The invention will be described in greater detail below in connection with an example embodiment, with reference to the Figures, wherein.

DETAILED DESCRIPTION OF PREFERRED EXAMPLE EMBODIMENTS OF THE INVENTION

Figure 1:
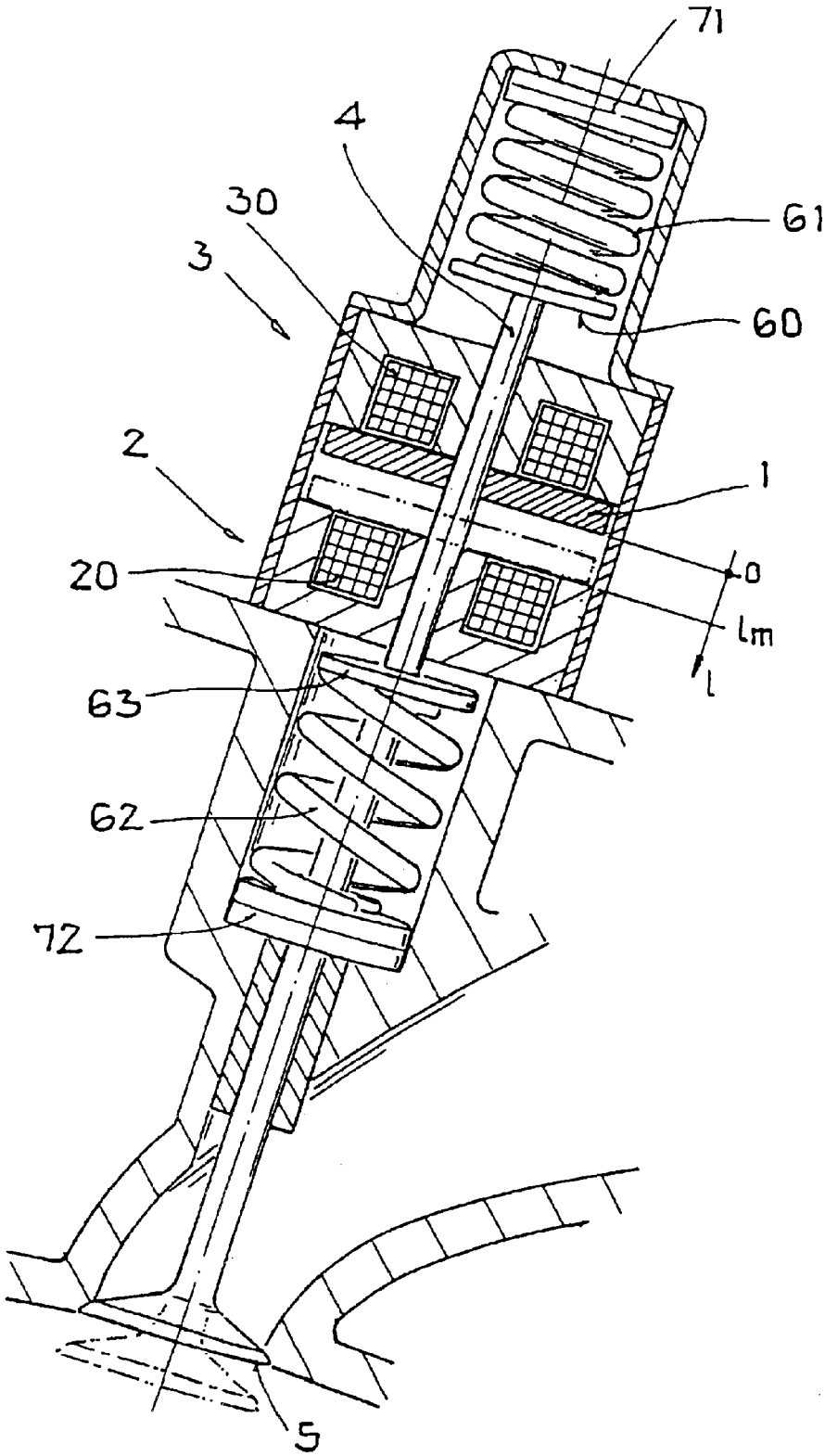
FIG. 1 shows an electromagnetic actuator for operating a gas exchange valve in an internal combustion machine.

As shown in FIG. 1, the actuator according to the invention comprises a push rod or valve stem 4 that is in force transmitting cooperation with a gas exchange valve 5, an armature 1 secured with the valve stem 4 perpendicularly to the valve stem longitudinal axis, an electromagnet 3 acting as a closing magnet and a further electromagnet 2 acting as an opening magnet, which is arranged spaced apart from the closing magnet 3 in the direction of the valve stem longitudinal axis. The electromagnets 2, 3 respectively comprise energizing or exciting coils 20 or 30, and pole surfaces lying across from one another. By means of an alternating energization of both electromagnets 2, 3, that is to say the exciting coils 20 or 30, the armature 1 is moved back and forth between the electromagnets 2, 3 along a stroke travel that is limited by the electromagnets 2, 3.

A spring arrangement includes a first spring 61 acting in the opening direction onto the armature 1 via a spring support disk 60 secured to the valve stem 4, and a second spring 62 acting in the closing direction onto the armature 1 via a spring support disk 63 secured to the valve stem 4. The spring arrangement holds the armature 1 in a neutral equilibrium position between the electromagnets 2, 3 in the de-energized condition of the exciting coils 20, 30. Furthermore, adjusting or setting means 71, 72 for setting the pre-stressing of the springs 61, 62 are provided. The setting means 71, 72 may, for example, be embodied as shim disks or washers, which effectuate a compression of the springs 61, 62, and thereby prescribe the pre-stressing of the respective springs 61, 62. They may, however, also be controllably embodied, and enable a stepless variation of the pre-stressing.

For starting the actuator, one of the electromagnets 2, 3 is energized, that is to say switched on, by applying an exciting voltage to the corresponding exciting coil 20 or 30, or a transient start-up oscillation routine is initiated, by means of which the armature 1 is first set into oscillation by alternating energization of the electromagnets 2, 3, in order to strike against the pole surface of the closing magnet 2 or the pole surface of the opening magnet 3 after a start-up oscillation transient time.

With a closed gas exchange valve 5, the armature 1 lies against the pole surface of the closing magnet 3 as shown in FIG. 1, and it is held in this position—the upper end position—as long as the closing magnet 3 is energized. In order to open the gas exchange valve 5, the closing magnet 3 is switched off, and next the opening magnet 2 is switched on. The first spring 61 acting in the opening direction accelerates the armature 1 through or beyond the rest position. By means of the opening magnet 2 which is now energized, additional kinetic energy is supplied to the armature 1, so that it reaches the pole surface of the opening magnet 2 despite possible friction losses, and there—at the bottom end position which is shown with dashed lines in FIG. 1—is held until the switching off of the opening magnet 2. For the renewed closing of the gas exchange valve 5, the opening magnet 2 is switched off and the closing magnet 3 is next again switched on. The armature 1 is thereby moved by the second spring 62 to the closing magnet 3 and is held there on its pole surface.

The stroke travel distance Im of the armature 1, over which the armature 1 travels—the motion of the armature 1 is referred to as the "flight" thereof in the following—is limited due to the prescribed spacing distance between the electromagnets 2, 3. The progressions or variations of the spring forces of the two springs 61, 62, that is to say the varying forces with which the springs 61, 62 act on the armature 1, are dependent on the armature position I and can be described in connection with spring characteristic curves.

Figure 2:
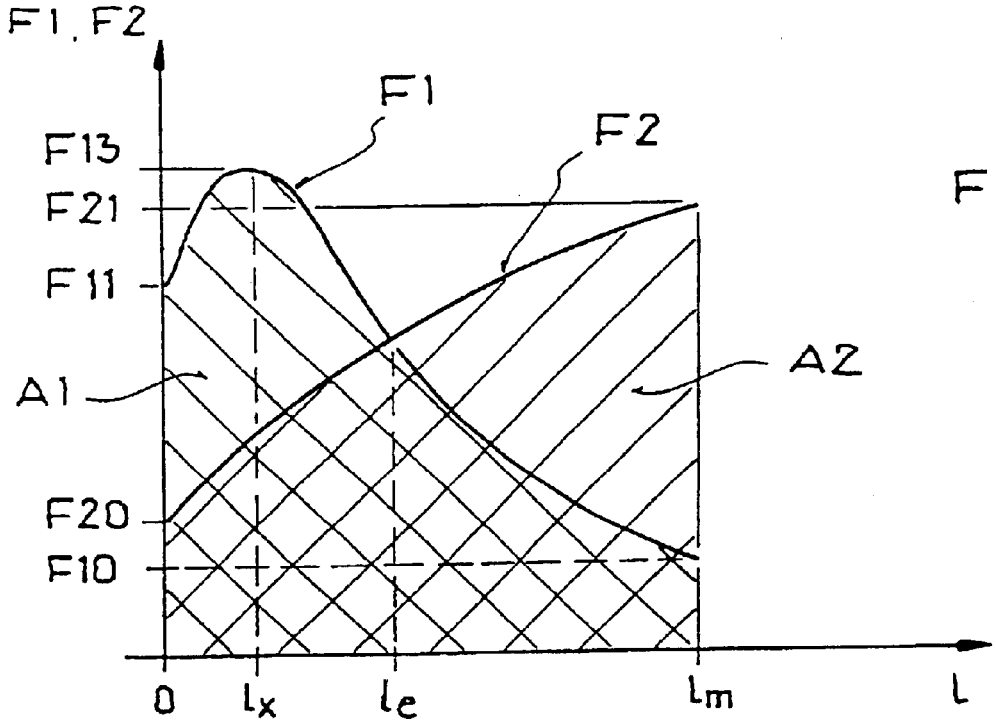
FIG. 2 shows a first force versus travel distance diagram with spring characteristic curves.

In the force versus travel distance diagram of FIG. 2, the spring characteristic curve of the first spring 61 is referenced with F1, and the spring characteristic curve of the second spring 62 is referenced with F2. During the flight of the armature 1 from the upper end position to the lower end position, that is to say from the armature position 0 to the armature position Im, the force of the first spring 61 increases at first from a holding value F11 to a maximum value F13, which is achieved at the armature position Ix, in order to thereafter fall off to an end value F10 lying below the holding value F11, whereby the end value F10 is achieved at the armature position Im, that is to say in connection with the armature 1 lying against the opening magnet 2. In contrast, the spring force of the second spring 62 increases from an end value F20, which is effective in the upper end position of the armature 1, monotonously but non-linearly to a holding value F21, which is achieved in the lower end position of the armature 1. The end values F10, F20 represent the pre-stressing or pre-biasing of the respective spring 61 or 62. Namely, the two springs 61 and 62 are adjusted or set in such a manner so that the area A1 under the spring characteristic curve F1 is equal to the area A2 under the spring characteristic curve F2. The areas A1 and A2 in that context correspond to the energy that is stored in the respective spring 61, 62, if these springs are compressed due to the motion of the armature. The two spring characteristic curves F1, F2 intersect each other at a point that prescribes the energetic center position Ie of the armature. This energetic center position Ie, which the armature 1 takes up with de-energized electromagnets 2, 3, generally does not correspond with the geometric center position between the electromagnets 2, 3 in connection with springs having different spring characteristic curves.

On the one hand, the substantial advantage of the first spring 61, due to the maximum value F13 of its spring characteristic curve F1, is that it is in the position to store so much energy, that the armature 1 will be moved with high velocity during the de-stressing of the first spring 61, which leads to short switching times, despite the small holding value F11. Due to the small holding value F11, on the other hand, the current requirement for holding the armature 1 in its upper end position, and therewith the energy requirement of the actuator, is small.

Figure 3:
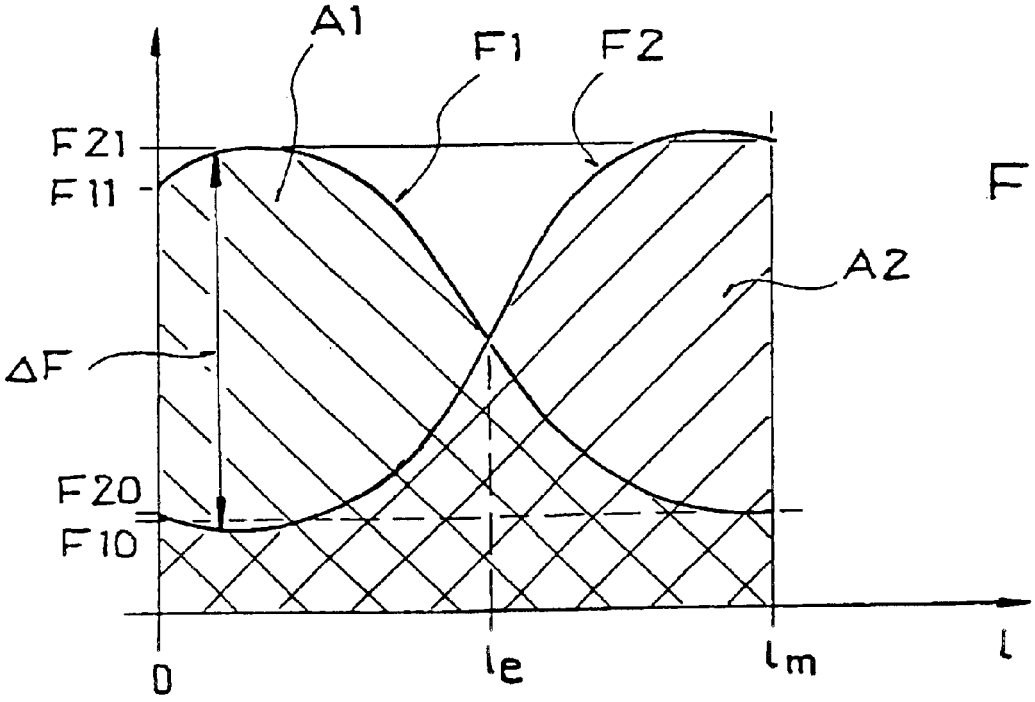
FIG. 3 shows a second force versus travel distance diagram with spring characteristic curves.

In the force versus travel distance diagram according to FIG. 3, the spring characteristic curve F2 of the second spring 62, with an increasing spacing distance I between armature 1 and closing magnet 2, comprises at first a decreasing progression, then an increasing progression, and thereafter again a decreasing progression. The areas A1, A2 under the spring characteristic curves F1, F2 of the springs 61, 62 are once again equally large. For these spring characteristic curves F1, F2 it is shown to be advantageous, that the difference ΔF between the two spring characteristic curves F1, F2, that is to say the resulting force acting on the armature 1, is large for a large range of the spacing distance I between the armature 1 and closing magnet 3. As a result of that, the gas exchange valve 5 may also be opened against a combustion chamber internal pressure, that is to say the energy requirement of the opening magnet 2 is small due to the high resulting force AF that is effective during the opening process.

The adjustment of the actuator is carried out before the installation of the actuator in the internal combustion machine. Thereby, first the pre-stressing of the second spring 62 is adjustingly set to the end value F20, at which a secure or reliable closing of the gas exchange valve 5 is ensured. Next, the second spring 62 is compressed by the spring travel distance corresponding to the stroke travel distance Im of the armature 1, and the progression of the spring force, which results thereby, is measured section-wise and integrated section-wise over the spring travel distance. The result of this integration corresponds to the energy that is stored in this context in the second spring 62. Thereby, the measurement of the spring force can be carried out by means of a load cell or a measuring gage.

The energy that is stored in the first spring 61 if the armature 1 is moved from its lower end position to its upper end position is also measured in the same manner as described above, namely by measuring the progression or variation of the spring force of the first spring 61 that results from the armature motion, and by integration of this progression over the spring travel distance, through which the first spring 61 is thereby compressed. Next, the energy values that have been determined in this manner are compared with one another, and the pre-stressing of the first spring 61 is adjustingly set in such a manner so that the same energy is stored in the two springs 61, 62, if these are compressed by the stroke travel distance Im. The actuator is only installed into the internal combustion machine after this adjustment.

In the present example embodiment, the actuator is adjusted before placing it into operation. Also conceivable, however, are an adjustment during the operation, and an after-adjustment dependent on operating parameters. In this case, the adjusting or setting means are controllably embodied, and the progressions of the spring forces are measured with measuring means, onto which the springs act, for example with pressure sensors, especially with piezocrystals. The adjusting or setting means are then controlled by control means, dependent on the measured spring forces, in such a manner so that the same energy is stored in both springs in connection with the maximum compression of the springs 61, 62 that is possible during the operation.

What is claimed is:

1. Electromagnetic actuator with two electromagnets arranged at a spacing distance relative to one another, and an armature (1) that is movable back and forth along a stroke travel distance (Im) between the electromagnets (2, 3) against the force of two springs (61, 62) acting against each other, characterized in that the springs (61, 62) are pre-stressed in such a manner, so that the same energy (A1, A2) is stored in both springs (61, 62) in connection with a compression of the springs (61, 62) that is prescribed by the stroke travel distance (Im) of the armature (1).

2. Electromagnetic actuator according to claim 1, characterized in that at least one of the springs (61, 62) comprises a non-linear spring characteristic curve (F1).

3. Electromagnetic actuator according to claim 2, characterized in that the spring characteristic curve (F1) of at least one of the springs (61, 62) comprises a maximum value (F13) at a position (Ix) of the armature (1) spaced away from the two electromagnets (2, 3).

4. Method for the adjusting of an electromagnetic actuator with two electromagnets (2, 3) arranged at a spacing distance relative to each other, and an armature (1) movable back and forth along a stroke travel distance between the electromagnets (2, 3) against the force of two springs (61, 62) acting against one another, characterized in that, for each spring (61, 62) the variation (F1, F2) of the spring force is measured, which results if the respective spring (61, 62) is compressed by a spring travel distance corresponding to a the stroke travel distance (Im) of the armature (1), that in connection with the measured variations (F1, F2) of the spring forces, the energy (A1, A2) is determined, which is stored in the respective spring (61, 62) due to the compression thereof, and that the pre-stressing (F10, F20) of one or both springs (61, 62) is set in such a manner so that the same energy (A1, A2) is stored in both springs (61, 62).

5. Electromagnetic actuator according to claim 1, characterized in that setting means (71, 72) for setting the pre-stressing of the springs (61, 62) are provided.

6. Electromagnetic actuator according to claim 5, characterized in that measuring means for measuring the variations of the spring forces of the springs (61, 62) in connection with the compression of the springs over the stroke travel distance are provided.

7. Electromagnetic actuator according to claim 6, characterized in that control means for controlling the setting means in accordance with the measured variations of the spring forces are provided.

8. An electromagnetic actuator comprising:

two electromagnets spaced apart from one another with a spacing distance therebetween;

an armature arranged to be movable back-and-forth along said spacing distance between said two electromagnets; and two springs that are coupled to said armature and that respectively exert oppositely directed spring forces onto said armature;

wherein said two springs are pre-stressed so that the same total spring energy is stored in each one of said two springs when said springs are respectively maximally compressed through a spring travel by moving said armature through said spacing distance between said two electromagnets.

9. The electromagnetic actuator according to claim 8, wherein said two springs respectively have different spring characteristics that respectively define a variation of said spring force of a respective one of said springs over said spring travel.

10. The electromagnetic actuator according to claim 9, wherein a rest position of said armature with said two electromagnets de-energized is not at a geometric center of said spacing distance between said two electromagnets.

11. The electromagnetic actuator according to claim 8, wherein a rest position of said armature with said two electromagnets de-energized is not at a geometric center of said spacing distance between said two electromagnets.

12. The electromagnetic actuator according to claim 8, wherein said same total spring energy of each respective one of said two springs is given by an integral of said spring force over said spring travel of said respective one of said springs.

13. A method of adjusting the electromagnetic actuator according to claim 8, comprising the steps:

a) while compressing a first one of said two springs through said spring travel thereof, measuring a first variation of a first said spring force of said first spring over said spring travel thereof;

b) while compressing a second one of said two springs through said spring travel thereof, measuring a second variation of a second said spring force of said second spring over said spring travel thereof;

c) from said first variation of said first spring force over said spring travel of said first spring, determining a first spring energy stored in said first spring due to said compressing of said first spring through said spring travel thereof;

d) from said second variation of said second spring force over said spring travel of said second spring, determining a second spring energy stored in said second spring due to said compressing of said second spring through said spring travel thereof;

e) pre-stressing one or both of said springs in said actuator to thereby adjust at least one of said first spring energy and said second spring energy so that said first spring energy and said second spring energy will both be equal to said same total spring energy.

14. The method according to claim 13, wherein said determining of said first spring energy in said step c) comprises integrating said first variation of said first spring force over said spring travel of said first spring, and said determining of said second spring energy in said step d) comprises integrating said second variation of said second spring force over said spring travel of said second spring.

15. The method according to claim 13, wherein said respective integrating is a section-wise integrating over said respective spring travel.

16. The method according to claim 13, further comprising a preliminary step of pre-stressing said first spring to a prescribed value, and wherein said step e) comprises pre-stressing said second spring so that said second spring energy of said second spring matches said first spring energy of said first spring that is pre-stressed to said prescribed value.

17. The method according to claim 13, wherein said first variation of said first spring force differs from said second variation of said second spring force, and wherein, after said step e), a rest position of said armature with said two electromagnets de-energized is not at a geometric center of said spacing distance between said two electromagnets.

* * * * *

UNITED STATES PATENT AND TRADEMARK OFFICE

CERTIFICATE OF CORRECTION

PATENT NO. : 6,838,965 B1
DATED : January 4, 2005
INVENTOR(S) : Von Gaisberg et al.

It is certified that error appears in the above-identified patent and that said Letters Patent is hereby corrected as shown below:

Title page,
Item [56], References Cited, U.S. PATENT DOCUMENTS, replace "6,230,763 B1 05/2001 Till" by -- 6,230,673 B1 05/2001 Sugimoto et al. --.

Column 1,
Line 63, after "one", replace "electromagnetic" by -- electromagnet --.

Signed and Sealed this

Thirtieth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,838,965 B1
APPLICATION NO. : 10/019336
DATED : January 4, 2005
INVENTOR(S) : Von Gaisberg et al.

It is certified that error appears in the above-identified patent and that said Letters Patent is hereby corrected as shown below:

Title page,
Item [56], References Cited,
Line 12, replace "6,230,763 B1 05/2001 Till" by --6,230,673 B1 05/2001 Sugimoto et al.--;

Signed and Sealed this

Nineteenth Day of September, 2006

JON W. DUDAS
*Director of the United States Patent and Trademark Office*